US011666166B2

(12) United States Patent
Yoon et al.

(10) Patent No.: US 11,666,166 B2
(45) Date of Patent: Jun. 6, 2023

(54) CLOTHES HANGER

(71) Applicant: LG ELECTRONICS INC., Seoul (KR)

(72) Inventors: Jihyun Yoon, Seoul (KR); Jeongjoon Roh, Seoul (KR); Ayeong Lee, Seoul (KR); Taehee Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 73 days.

(21) Appl. No.: 17/435,778

(22) PCT Filed: Feb. 28, 2020

(86) PCT No.: PCT/KR2020/002913
§ 371 (c)(1),
(2) Date: Jan. 5, 2022

(87) PCT Pub. No.: WO2020/189921
PCT Pub. Date: Sep. 24, 2020

(65) Prior Publication Data

US 2022/0117424 A1 Apr. 21, 2022

(30) Foreign Application Priority Data

Mar. 19, 2019 (KR) ..... 10-2019-0031059

(51) Int. Cl.
*A47G 25/44* (2006.01)
*A47G 25/40* (2006.01)

(52) U.S. Cl.
CPC ..... *A47G 25/443* (2013.01); *A47G 25/4038* (2013.01); *A47G 25/4046* (2013.01)

(58) Field of Classification Search
CPC ..... A47G 25/443; A47G 25/4038; A47G 25/4046; A47G 25/44; A47G 25/441;
(Continued)

(56) References Cited

U.S. PATENT DOCUMENTS 1,841,719 A 1/1932 Emery et al.
1,978,123 A * 10/1934 Anderson ..... A47G 25/20 223/69
(Continued)

FOREIGN PATENT DOCUMENTS

BE 483198 A 7/1948
CN 1545392 A 11/2004
(Continued)

OTHER PUBLICATIONS

International Search Report in International Application No. PCT/KR2020/002913 (4 pages).

*Primary Examiner* — Ismael Izaguirre
(74) *Attorney, Agent, or Firm* — Birch, Stewart, Kolasch & Birch, LLP

(57) ABSTRACT

A clothing hanger may include a vertical frame, a support frame including a center part connected to an upper end of the vertical frame and a pair of support parts extending from both sides of the center part to support clothing, a moving bar provided in an inner portion of the vertical frame and capable of being elevated, a moving block embedded in the support part and movable in a left and right direction according to the elevation of the moving bar, a connecting rod connecting the moving bar and the moving block, a main link located at the front and rear of the support part and rotatably connected to the moving block, a sub link rotatably connected to the support part and the main link, respectively, and a vertical bar connected to the main link and extending in a vertical direction.

20 Claims, 15 Drawing Sheets

(58) Field of Classification Search
CPC .. A47G 25/442; A47G 25/4061; A47G 25/52; A47G 25/621–628; A47G 25/66; A47G 25/68; A47G 25/70
See application file for complete search history.

(56) References Cited

U.S. PATENT DOCUMENTS 2,455,066 A * 11/1948 Kempf ..... A47G 25/52 223/91
2,531,108 A * 11/1950 Taggart ..... A47G 25/443 223/89
2,666,559 A * 1/1954 Wexler ..... A41H 5/00 223/68
3,273,765 A * 9/1966 Piilola ..... D06F 71/16 223/69
3,737,080 A * 6/1973 Paris ..... D06F 73/00 223/70
4,917,278 A * 4/1990 Ventimiglia ..... A47G 25/20 223/68
2004/0237356 A1 12/2004 Khasianovich

FOREIGN PATENT DOCUMENTS

KR 20-0446345 Y1 10/2009
KR 10-2015-0077242 A 7/2015
KR 10-2016-0122344 A 10/2016
KR 10-2017-0009479 A 1/2017
KR 10-1811318 B1 12/2017
WO WO 2018/230944 A1 12/2018

* cited by examiner

CLOTHES HANGER

CROSS-REFERENCE TO RELATED APPLICATIONS

This application is a U.S. National Phase of PCT International Application No. PCT/KR2020/002913, filed on Feb. 28, 2020, which claims priority under 35 U.S.C. 119(a) to Patent Application No. 10-2019-0031059, filed in the Republic of Korea on Mar. 19, 2019, the contents of both of which are hereby incorporated by reference herein in their entirety.

TECHNICAL FIELD

The present disclosure relates to a clothing hanger.

BACKGROUND

A clothing hanger is a device for hanging clothing. In general, the clothing hanger may include a hook and a hanging part formed to be inclined downward from the lower end of the hook to both sides. The hook may be hung and suspended on a holder such as a wardrobe, and clothing may be hung and supported on the hanging part.

The functional clothing hanger may have a variable structure for the convenience of use or prevention of damage to clothing. For example, the clothing hanger disclosed in Prior Document 1 (KR10-1811318B1) is capable of adjusting the length of the shoulder holding part, and in the clothing hanger disclosed in Prior Document 2 (KR10-2017-0009479A), the angle of the shoulder hanging part and the unfolding support part can be adjusted.

KR10-1811318B1 (One-touch folding clothing hanger, registered on Dec. 15, 2017)

KR10-2017-0009479A (Multifunctional clothing hanger, published on Jan. 1, 2017)

Technical Problem

An object to be solved by the present disclosure is to provide a clothing hanger that can be extended in the front and rear direction to support clothing of various sizes.

Another object to be solved by the present disclosure is to provide a clothing hanger capable of keeping the clothing taut by applying a mechanical force to the clothing.

Another object to be solved by the present disclosure is to provide a clothing hanger that easily extends in the front and rear direction and returns to the original state thereof.

Technical Solution

A clothing hanger according to an embodiment of the present disclosure may include a vertical frame, a support frame including a center part connected to an upper end of the vertical frame and a pair of support parts formed long from both sides of the center part to support clothing, a moving bar configured to be provided in an inner portion of the vertical frame to be capable of elevating, a moving block configured to be embedded in the support part and to move in a left and right direction according to the elevation of the moving bar, a connecting rod configured to connect the moving bar and the moving block, a main link configured to be located at the front and rear of the support part and to be rotatably connected to the moving block, a sub link configured to be rotatably connected to the support part and the main link, respectively, and a vertical bar configured to be connected to the main link and to be formed long in a vertical direction.

The clothing hanger may further include a handle configured to be connected to the lower end of the moving bar and located below the vertical frame.

The support frame may further include an upper body fastened on the upper side of the center part. The upper body may include a hook fastened to the upper surface of the upper body and an elastic band which is elastically deformed and surrounds at least a portion of the upper body.

The clothing hanger may further include a band fixing device configured to be fastened at the front of the upper body and to fix the elastic band.

The clothing hanger may further include an elastic member configured to provide an upward elastic force to the moving bar.

The clothing hanger may further include a stopper configured to prevent the lifting of the moving bar. The stopper may include a button provided on the outer surface of the vertical frame, a stopper main body formed long from the button in a horizontal direction and configured to pass through the vertical frame, and a protrusion configured to protrude from the stopper main body and to hang on the hanging part of the moving bar.

A plurality of hanging parts may be formed, and the plurality of hanging parts may be located at different heights from each other.

The clothing hanger may further include a compression spring configured to provide an elastic force to the stopper in a direction in which the protrusion hangs on the hanging part.

The hanging part may include a horizontal surface on which the protrusion hangs, and an inclined surface connected to the horizontal surface and configured to press the protrusion in a direction in which the stopper compresses the compression spring.

A connector to which the main link may be rotatably connected is provided on the front and rear surfaces of the moving block, and a long hole through which the connector passes and which is formed long in the left and right direction may be formed on the front and rear surfaces of the support part.

The main link may include a first connection part located at an inner end part of the main link and connected to the moving block, a second connection part located at an outer end part of the main link and connected to the vertical bar, and a third connection part located between the first connection part and the second connection part and to which the sub link is connected.

A distance between the third connection part and the second connection part may be shorter than a distance between the third connection part and the first connection part.

The clothing hanger may further include a lower frame including a fastening part fastened to a lower portion of the vertical frame and a pair of extension parts formed long at both sides of the fastening part, a lower moving block embedded in the extension part and configured to move according to the elevation of the moving bar in the left and right direction, a lower connecting rod configured to connect the moving bar and the lower moving block, a lower main link located at the front and rear of the extension part and rotatably connected to the lower moving block, and a lower sub link rotatably connected to the extension part and the lower main link, respectively.

The vertical bar may connect the main link and the lower main link.

The clothing hanger may further include a side frame configured to be formed long in the vertical direction and to connect the support part and the extension part.

The side frame may be elastically deformable.

A connector to which the main link may be rotatably connected is provided on the front and rear surfaces of the lower moving block, and a long hole through which the connector passes and which is formed long in the left and right direction may be formed on the front and rear surfaces of the extension part.

The lower main link may include a first connection part located at an inner end part of the lower main link and connected to the lower moving block, a second connection part located at an outer end part of the lower main link and connected to the vertical bar, and a third connection part located between the first connection part and the second connection part and to which the lower sub link is connected.

A distance between the third connection part and the second connection part may be shorter than a distance between the third connection part and the first connection part.

The clothing hanger may further include a horizontal bar configured to connect the lower portions of a pair of vertical bars spaced apart in the left and right direction to each other and having a hook on the upper side thereof.

ADVANTAGEOUS EFFECT

According to a preferred embodiment of the present disclosure, a vertical bar may be connected to the main link rotating in the front and rear direction. Accordingly, the clothing hanger can be extended in the front and rear direction to stably support clothing of various sizes.

In addition, the moving bar may be interlocked with the main link by the connecting rod and the moving block. Accordingly, the user can simply extend the clothing hanger in the front and rear direction by pulling the handle connected to the moving bar downward.

In addition, the sub link assists the rotation of the main link so that the vertical bar can smoothly rotate in the front and rear direction.

In addition, the upper body included in the support frame may be provided with an elastic band elastically deformed, the band fixing device may fix the elastic band. This allows the elastic band to stably support the collar of the clothing.

In addition, when the user presses the button, the moving bar can move upward by the elastic force of the elastic member, and the extended hangers in the front and rear direction can be easily restored.

In addition, a plurality of hanging parts to which the stopper is hung may be formed at different heights of the moving bar from each other. Accordingly, the degree of extension of the clothing hanger in the front and rear direction can be easily adjusted.

In addition, the compression spring may provide an elastic force to the stopper in a direction in which the protrusion hangs on the hanging part. Accordingly, if the user does not apply force to the button, the stopper can prevent the moving bar from lifting.

In addition, the hanging part may include a horizontal surface and an inclined surface. Accordingly, in a case where the moving bar lowers, the protrusion does not hang on the hanging part, but in a case where the moving bar lifts, the protrusion may hang on the hanging part.

In addition, a long hole through which a connector connected to the moving block passes may be formed on the front and rear surfaces of the support part of the support frame. Accordingly, the movement of the moving block in the left and right direction can be guided, and the main link can be easily connected to the connector.

In addition, both end portions of the main link may be connected to the moving block and the vertical bar, and the sub link may be connected between both end portions of the main link. In this case, the connection part to which the sub-link is connected may be adjacent to the end portion to which the vertical bar is connected. Accordingly, the vertical bar can easily move by a preset range in the front and rear direction.

In addition, the lower end of the vertical bar may be connected to the lower main link that rotates in the front and rear direction. Accordingly, the vertical bar can apply mechanical force from the upper part to the lower part of the clothing, as a whole, in the front and rear direction, and the clothing can be kept taut.

In addition, the side frame may be elastically deformed to suit the shape of the clothing to apply mechanical force.

In addition, the hook provided on the horizontal bar can apply a downward mechanical force to the clothing. This may cause the clothing to be taut in the vertical direction.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Hereinafter, specific embodiments of the present disclosure will be described in detail with drawings.

The clothing referred to in this specification includes not only clothing and apparel, but also objects that can be worn by a person, such as shoes, socks, gloves, hats, and scarves, as well as objects that can be used by a person such as dolls, towels, and blankets, and includes all objects that can perform washing.

Figure 1:
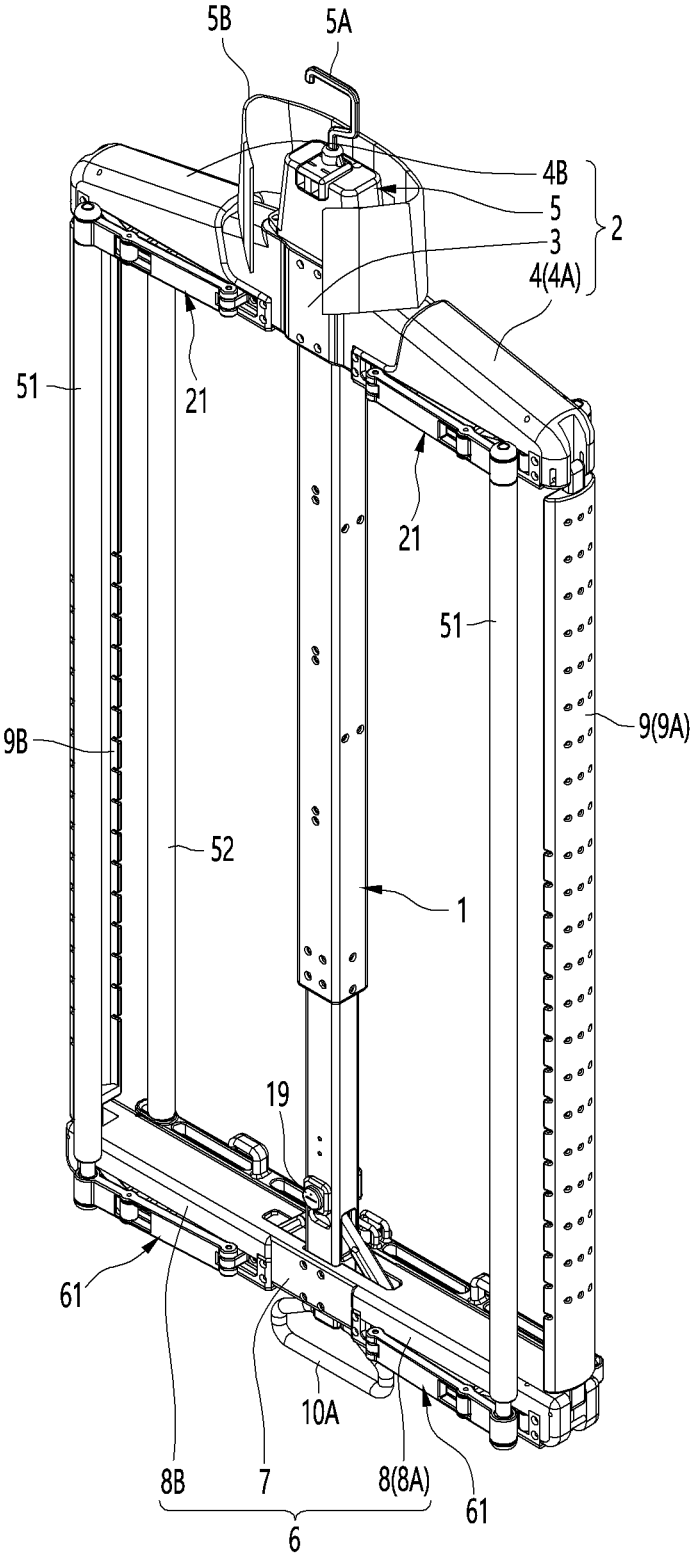
FIG. 1 is a perspective view illustrating a clothing hanger according to an embodiment of the present disclosure.
Figure 2A:
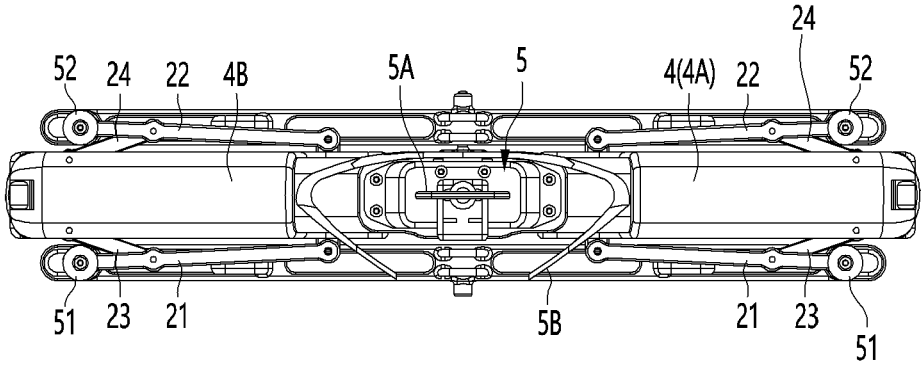
FIG. 2A is a plan view illustrating a clothing hanger according to an embodiment of the present disclosure.
Figure 2B:
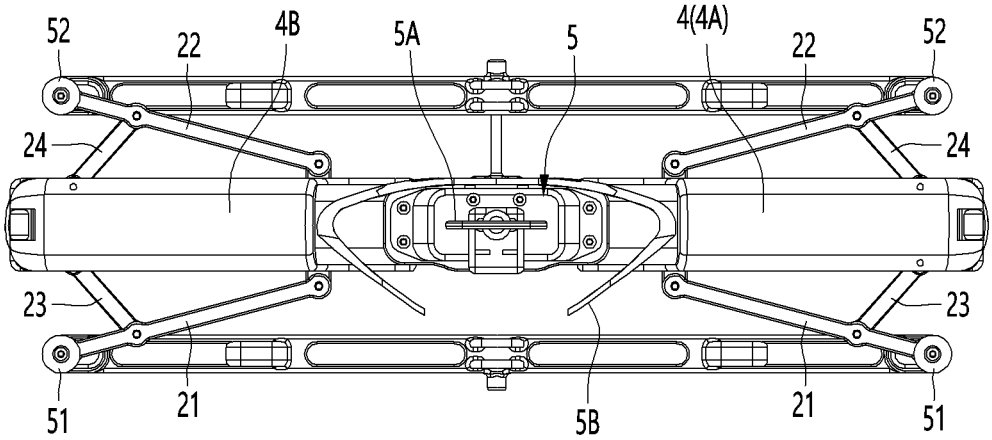
FIG. 2B is a plan view illustrating a state where the clothing hanger illustrated in FIG. 2A is extended in a front and rear direction.
Figure 3A:
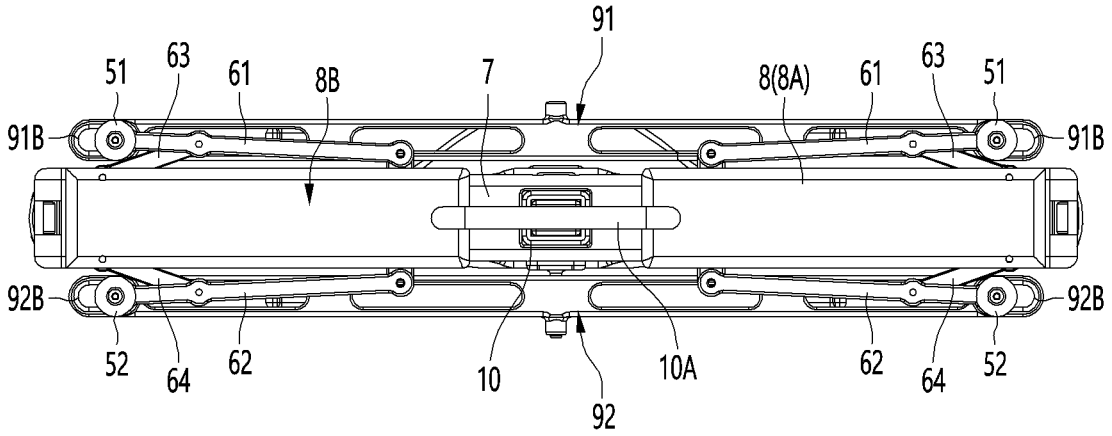
FIG. 3A is a bottom view illustrating a clothing hanger according to an embodiment of the present disclosure.
Figure 3B:
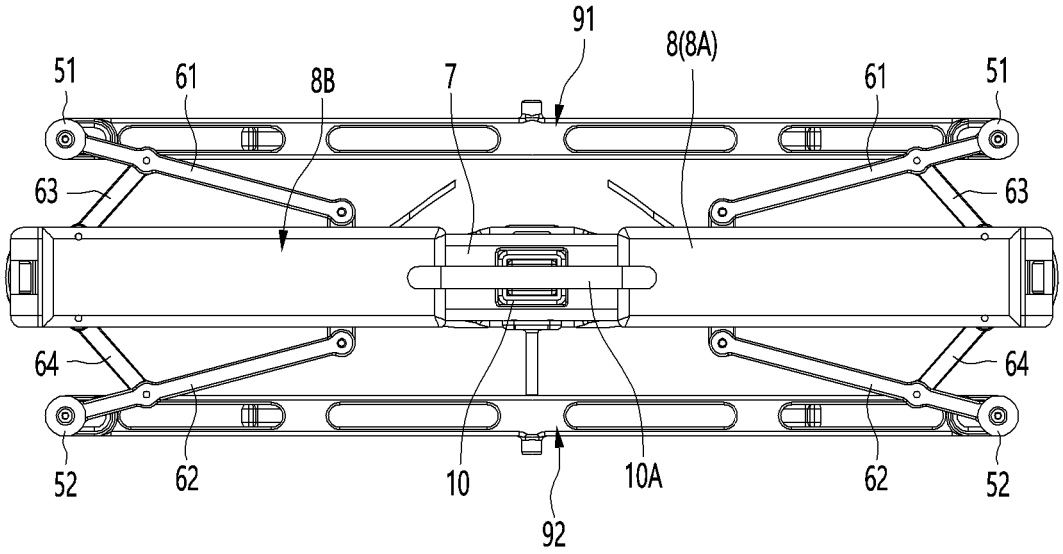
FIG. 3B is a plan view illustrating a state where the clothing hanger illustrated in FIG. 3A is extended in a front and rear direction.

FIG. 1 is a perspective view illustrating a clothing hanger according to an embodiment of the present disclosure, FIG. 2A is a plan view illustrating a clothing hanger according to an embodiment of the present disclosure, FIG. 2B is a plan view illustrating a state where the clothing hanger illustrated in FIG. 2A is extended in a front and rear direction, FIG. 3A is a bottom view illustrating a clothing hanger according to an embodiment of the present disclosure, and FIG. 3B is a plan view illustrating a state where the clothing hanger illustrated in FIG. 3A is extended in a front and rear direction.

The clothing hanger according to an embodiment of the present disclosure may include a vertical frame 1, a support frame 2, a main link 21 and 22, a sub link 23 and 24, and a vertical bar 51 and 52.

The vertical frame 1 may be formed long in the vertical direction. A space in which the moving bar 10 to be described later is received may be formed inside the vertical frame 1.

The support frame 2 may be connected to the upper end of the vertical frame 1. The support frame 2 may support clothing. The support frame 2 may be formed long in the left and right direction.

In more detail, the support frame 2 may include a center part 3 connected to the upper end of the vertical frame 1 and a pair of support parts 4 formed long from both sides of the center part 3 to support clothing. In addition, the support frame 2 may further include an upper body 5 fastened to the upper side of the center part 3.

The center part 3 may be located in the center of the support frame 2. The center part 3 may be fastened to the upper end of the vertical frame 1 from the upper side of the vertical frame 1.

A space in which the upper end portion of the moving bar 10 (see FIG. 4) is located may be formed inside the center part 3.

The support part 4 may support the shoulder portion of the clothing. The upper surface of the support part 4 may be formed long in an inclined direction such that the height is lowered as the distance from the center part 3 is increased. The bottom surface of the support part 4 may be formed horizontally.

The pair of support parts 4 may include a first support part 4A located on one side of the center part 3 and a second support part 4B located on the other side of the center part 3.

A space in which a moving block 30 (see FIG. 4) and a connecting rod 31 (see FIG. 4) connected to the moving block 30 are received may be formed in the support part 4.

The inner space of the support part 4 may communicate with the inner space of the center part 3.

The upper body 5 may be fastened to the center part 3 from the upper side of the center part 3. An inner space in which the moving bar 10 (see FIG. 4) can lift may be formed inside the upper body 5. In other words, the inner space of the upper body 5 may communicate with the inner space of the center part 3.

A hook 5A of the upper body 5 may be provided. The hook 5A may be connected to the upper portion of the upper body 5. The hook 5A may be hung on a holder such as a wardrobe to support the entire clothing hanger.

The upper body 5 may be provided with an elastic band 5B. The elastic band 5B may surround at least a portion of the upper body 5 from the rear. The height of the elastic band 5B may be higher than the height of the upper body 5.

The elastic band 5B is elastically deformed and can support the collar of clothing. The elastic band 5B may surround the unfolded collar of the clothing from the outside.

The elastic band 5B may be fixed by a band fixing device 60 (see FIG. 13) to be described later.

The main links 21 and 22 may be located at the front and rear of the support part 4 of the support frame 2. The main links 21 and 22 may be rotatably connected by a moving block 30 (see FIG. 4) to be described later.

The main links 21 and 22 may be disposed long in the left and right direction. Inner end portions of the main links 21 and 22 may be connected to the moving block 30, and outer end portions of the main links 21 and 22 may be connected to vertical bars 51 and 52 to be described later. The inner end portion of the main links 21 and 22 may mean an end portion close to the center part 3 among both end portions thereof, and an outer end portion may mean an end portion far from the center part 3 among both end portions thereof.

The main links 21 and 22 can rotate with respect to the support part 4. When the inner end portion of the main links 21 and 22 moves outward, the main links 21 and 22 may rotate about the inner end portion. In this case, the outer end portion of the main links 21 and 22 may move away from the support part 4 in the front and rear direction.

The rotation of the main links 21 and 22 may be adjusted according to the operation of a moving bar 10 and a handle 10A, which will be described later.

A plurality of main links 21 and 22 may be provided. The plurality of main links 21 and 22 may include a front link 21 located in front of the support part 4 and a rear link 22 located in the rear of the support part 4.

A front link 21 may be located in front of the first support part 4A and the second support part 4B, respectively, and a rear link 22 may be located in the rear of the first support part 4A and the second support part 4B, respectively. In other words, a pair of the front link 21 and a pair of the rear link 22 may be provided.

The front link 21 can rotate forward with respect to the support part 4. In more detail, when the inner end portion of the front link 21 moves outward, the front link 21 may rotate about the inner end portion. At this time, the outer end portion of the front link 21 may move away from the support part 4 forward.

The rear link 22 can rotate rearward with respect to the support part 4. In more detail, when the inner end portion of the rear link 22 moves outward, the rear link 22 may rotate about the inner end portion. At this time, the outer end portion of the rear link 22 may move away from the support part 4 rearward.

The sub links 23 and 24 may connect the support part 4 and the main links 21 and 22. The sub links 23 and 24 may be rotatably connected to the support part 4 and the main links 21 and 22, respectively.

The sub links 23 and 24 can assist the rotation of the main links 21 and 22. Outer end portions of the sub links 23 and 24 may be rotatably connected to the support part 4, and inner end portions of the sub links 23 and 24 may be rotatably connected to the main links 21 and 22.

A plurality of sub links 23 and 24 may be provided. The plurality of sub links 23 and 24 may include a front sub link 23 connecting the support part 4 and the front link 21, and a rear sub link 24 connecting the support part 4 and the rear link 22.

A front sub link 23 may be connected to the front side of the first support part 4A and the second support part 4B, respectively, and a rear sub link 24 may be connected to the rear of the first support part 4A and the second support part 4B, respectively. In other words, a pair of each of the front sub links 23 and a pair of the rear sub links 24 may be provided.

The front sub link 23 can rotate forward with respect to the support part 4. In more detail, in a case where the front link 21 rotates forward, the front sub link 23 may rotate about the outer end portion. At this time, the inner end portion of the front sub link 23 may move away from the support part 4 in the front.

The rear sub link 24 can rotate rearward with respect to the support part 4. In more detail, in a case where the rear link 22 is rotated rearward, the rear sub link 24 may rotate about the outer end portion. At this time, the inner end portion of the rear sub link 24 may move away from the support part 4 rearward.

The vertical bars 51 and 52 may be formed long in the vertical direction. The vertical bars 51 and 52 may be connected to the main links 21 and 22. In more detail, the upper end portions of the vertical bars 51 and 52 may be connected to the outer end portions of the main links 21 and 22. The lower end portions of the vertical bars 51 and 52 may be connected to the outer end portions of the lower main links 61 and 62 to be described later.

The vertical bars 51 and 52 may apply mechanical force to the clothing in the front and rear direction. In more detail, when the clothing is hung on the support frame 2, the vertical bars 51 and 52 may be located inside the clothing. In this state, when the main links 21 and 22 and the lower main links 61 and 62 rotate in the front and rear direction, the vertical bars 51 and 52 may apply mechanical force to the clothing in the front and rear direction. Accordingly, this allows the clothing to be kept taut.

A plurality of vertical bars 51 and 52 may be provided. The plurality of vertical bars 51 and 52 may include a front vertical bar 51 connected to the front link 21 and a rear vertical bar 52 connected to the rear link 22.

The front vertical bar 51 may be connected to each of the front link 21 connected to the first support part 4A and the front link 21 connected to the second support part 4B. A rear vertical bar 52 may be connected to each of the rear link 22 connected to the first support part 4A and the rear link 22 connected to the second support part 4B. In other words, a pair of the front vertical bars 51 and a pair of the rear vertical bars 52 may be provided.

When the front link 21 is rotated forward and the rear link 22 is rotated rearward, the front vertical bar 51 and the rear vertical bar 52 may move away from each other in the front and rear direction. Accordingly, this allows the clothing hanger to extend in the front and rear direction.

The clothing hanger according to an embodiment of the present disclosure may further include a lower frame 6, lower main links 61 and 62, and lower sub links 63 and 64.

The lower frame 6 may be fastened to the lower portion of the vertical frame 1. Preferably, the lower frame 6 may be connected to the lower end portion of the vertical frame 1. The lower frame 6 may be formed long in the left and right direction.

In more detail, the lower frame 6 may include a fastening part 7 fastened to the lower part of the vertical frame 1 and a pair of extension parts 8 formed long on both sides of the fastening part 7.

The fastening part 7 may be located in the center of the lower frame 6. The fastening part 7 may be fastened to at least one of the front and back surfaces of the lower part of the vertical frame. In more detail, the vertical frame 1 passes through the fastening part 7, and the front and rear surfaces of the vertical frame 1 may be fastened to the inner surface of the fastening part 7.

The extension part 8 may extend long from the fastening part 7 to both sides. The extension part 8 and the fastening part 7 may be integrally formed. The bottom surface of the extension part 8 may be formed horizontally.

The pair of extension parts 8 may include a first extension part 8A located on one side of the fastening part 7 and a second extension part 8B located on the other side of the fastening part 7. The first extension part 8A may vertically overlap the first support part 4A, and the second extension part 8B may vertically overlap the second support part 4B.

A space in which the lower moving block 70 (see FIG. 4) and the lower connecting rod 71 (see FIG. 4) connected to the lower moving block 70 are received may be formed inside the extension part 8.

The inner space of the first extension part 8A and the inner space of the second extension part 8B may be separated without communicating with each other but is not limited thereto.

The lower main links 61 and 62 may be located at the front and rear of the extension part 8 of the lower frame 2.

The lower main links 61 and 62 may be rotatably connected by a lower moving block 70 (see FIG. 4) to be described later.

The lower main links 61 and 62 may be disposed long in the left and right direction. The inner end portions of the lower main links 61 and 62 may be connected to the lower moving block 70, and the outer end portions of the lower main links 61 and 62 may be connected to the vertical bars 51 and 52. The inner end portions of the lower main links 61 and 62 may mean an end portion close to the center part 3 among both end portions, and an outer end portion may mean an end portion far from the center part 3 among both end portions.

The lower main links 61 and 62 can rotate with respect to the extension part 8. When the inner end portions of the lower main links 61 and 62 move outward, the lower main links 61 and 62 may rotate about the inner end portions. In this case, the outer end portions of the lower main links 61 and 62 may move away from the extension part 4 in the front and rear direction.

The rotation of the lower main links 61 and 62 may be adjusted according to the operation of the moving bar 10 and the handle 10A, which will be described later. The lower main links 61 and 62 may be rotated simultaneously with the main links 21 and 22.

A plurality of lower main links 61 and 62 may be provided. The plurality of lower main links 61 and 62 may include a front lower link 61 located in front of the extension part 8 and a rear lower link 62 located in the rear of the extension part 8.

The front lower link 61 may be located in front of the first extension part 8A and the second extension part 8B, respectively, and the rear lower link 62 may be located in the rear of the first extension part 8A and the second extension part 8B, respectively. In other words, a pair of the front lower links 61 and a pair of the rear lower links 62 may be provided.

The front lower link 61 can rotate forward with respect to the extension part 8. In more detail, when the inner end portion of the front lower link 61 moves outward, the front lower link 61 may rotate about the inner end portion. At this time, the outer end portion of the front lower link 61 may move away from the extension part 8 forward.

The rear lower link 62 can rotate rearward with respect to the extension part 8. In more detail, when the inner end portion of the rear lower link 62 moves outward, the rear lower link 62 may rotate about the inner end portion. At this time, the outer end portion of the rear lower link 62 may move away from the extension part 8 rearward.

The lower sub links 63 and 64 may connect the extension part 8 and the lower main links 61 and 62. The lower sub links 63 and 64 may be rotatably connected to the extension part 8 and the lower main links 61 and 62, respectively.

The lower sub links 63 and 64 may assist in the rotation of the lower main links 61 and 62. The outer end portions of the lower sub links 63 and 64 may be rotatably connected to the extension part 8, and the inner end portions of the lower sub links 63 and 64 may be rotatably connected to the lower main links 61 and 62.

A plurality of lower sub links 63 and 64 may be provided. The plurality of lower sub links 63 and 64 may include a front lower sub link 63 connecting the extension part 8 and the front lower link 61 and a rear lower sub link 64 connecting the extension part 8 and the rear lower link 62.

The front lower sub links 63 may be connected to the front sides of the first extension part 8A and the second extension part 8B, respectively, and the rear lower sub links 64 may be connected to the rear sides of the first extension part 8A and the second extension part 8B. In other words, a pair of the front lower sub links 63 and a pair of the rear lower sub links 64 may be provided.

The front lower sub link 63 can rotate forward with respect to the extension part 8. In more detail, in a case where the front lower link 61 rotates forward, the front lower sub link 63 may rotate about the outer end portion. At this time, the inner end portion of the front lower sub link 63 may be forwardly away from the extension part 8.

The rear lower sub link 64 can rotate rearward with respect to the extension part 4. In more detail, in a case where the rear lower link 62 is rotated rearward, the rear lower sub link 64 may rotate about the outer end portion. At this time, the inner end portion of the rear lower sub link 64 may move away from the extension part 8 rearward.

The vertical bar 51 formed long in the vertical direction may connect the main links 21 and 22 and the lower main links 61 and 62. In more detail, the front vertical bar 51 may connect the front link 21 and the front lower link 61, and the rear vertical bar 52 may connect the rear link 22 and the rear lower link 62. In more detail, the front vertical bar 51 may connect the outer end portion of the front link 21 and the outer end portion of the front lower link 61, and the rear vertical bar 52 may be connected to the outer end portion of the rear link 22 and the outer end portion of the rear lower link 62.

The clothing hanger according to the embodiment of the present disclosure may further include a side frame 9.

The side frame 9 may be formed long in the vertical direction.

The side frame 9 may connect the support frame 2 and the lower frame 6. In more detail, the side frame 9 may connect the outer end portion of the support part 4 and the outer end portion of the extension part 8.

The inner surface of the side frame 9 may face between the front vertical bar 51 and the rear vertical bar 52. In other words, the side frame 9 may be located outside the space between the front vertical bar 51 and the rear vertical bar 52.

The side frame 9 may be elastically deformed. The side frame 9 may include a non-metal material. The side frame 9 may include an injection plastic material. A plurality of vertically spaced grooves may be formed in the side frame 9. As a result, the side frame 9 may be elastically deformed to suit the shape of the clothing, and a mechanical force may be applied thereto.

A pair of side frames 9 may be provided. The pair of side frames 9 may include a first side frame 9A and a second side frame 9B. The first side frame 9A may connect the first support part 4A and the first extension part 8A. The second side frame 9B may connect the second support part 4B and the second extension part 8B.

The first side frame 9A may be located on one side of the vertical frame 1, and the second side frame 9B may be located on the other side of the vertical frame 1. The first side frame 9A and the second side frame 9B may overlap the vertical frame 1 in the left and right direction.

The side frame 9 can apply a mechanical force to both sides of the clothing. In more detail, the side frame 9 may apply a mechanical force from the inside to the outside of the body of the clothing hung on the clothing hanger. Accordingly, the clothing may be kept taut, and refresh operations such as ironing may be performed smoothly.

Figure 4:
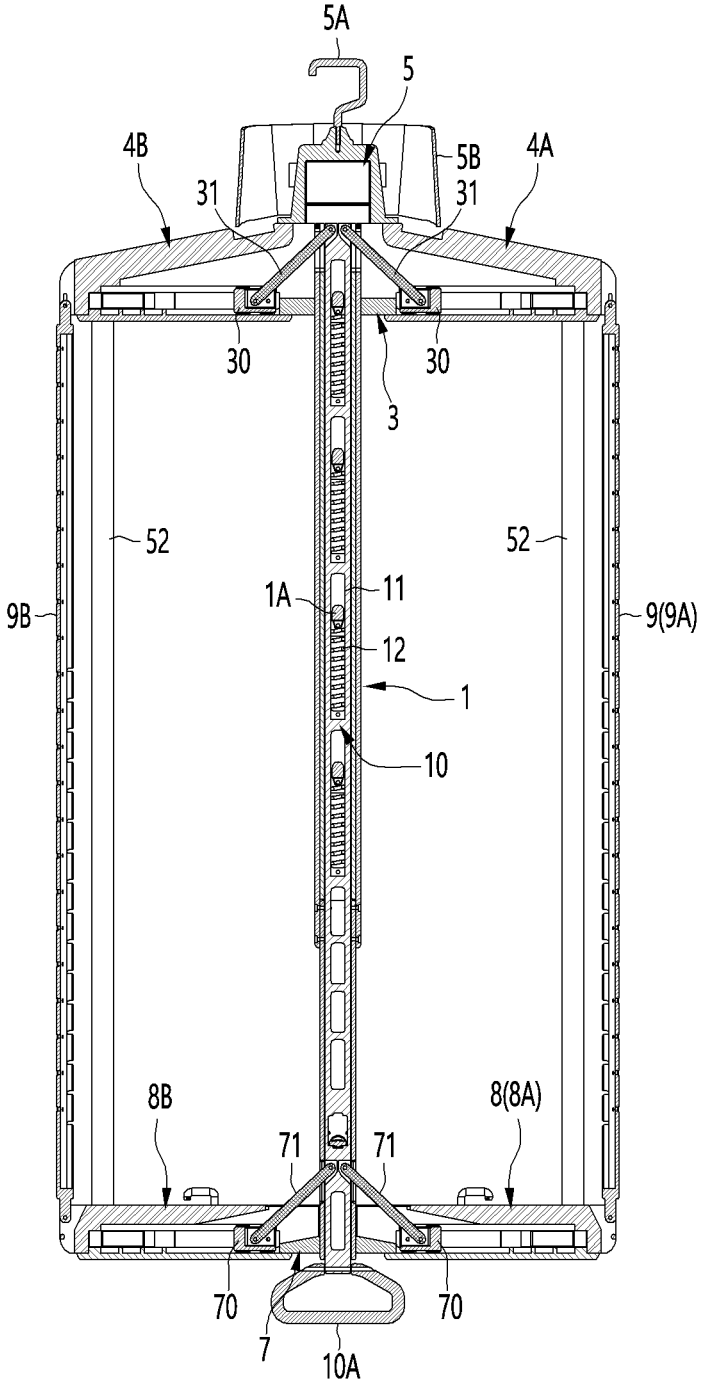
FIG. 4 is a cross-sectional view illustrating the inside of the clothing hanger according to an embodiment of the present disclosure.

FIG. 4 is a cross-sectional view illustrating the inner portion of the clothing hanger according to an embodiment of the present disclosure.

The clothing hanger according to an embodiment of the present disclosure may include a moving bar 10, a moving block 30, and a connecting rod 31. The clothing hanger according to an embodiment of the present disclosure may further include a lower moving block 70 and a lower connecting rod 71.

The moving bar 10 may be provided so as to be capable of elevating inside the vertical frame 1. The moving bar 10 may be formed long elongated in parallel with the vertical frame 1 in the vertical direction.

The lower end of the moving bar 10 may protrude downward of the vertical frame 1.

A handle 10A may be connected to the lower end of the moving bar 10. The handle 10A may be located below the vertical frame 1 and the lower frame 6. The user can lower the moving bar 10 by pulling the handle 10A, and the main links 21 and 22 and the lower main links 61 and 62 can be located in the front and rear direction by the connecting rod 31 connected to the moving bar 10 and the moving block 30 connected to the connecting rod 31.

The upper end of the moving bar 10 may be located in the center portion 3 of the support frame 2. An insertion hole 3A passing through the bottom surface of the center part 3 in the vertical direction may be formed so that the moving bar 10 is inserted thereinto. It is also possible that the upper end of the moving bar 10 lifts to the inside of the upper body 5.

The moving block 30 may be built in the support part 4 of the support frame 2. The moving block 30 can be moved inside the support part 4 in the left and right direction. The moving block 30 may be built in the first support part 4A and the second support part 4B, respectively. The moving block 30 built in the first support part 4A and the moving block 30 built in the second support part 4B may move in opposite directions to each other.

The moving block 30 may be rotatably connected to the main links 21 and 22 described above. The main links 21 and 22 may rotate in the front and rear direction according to the movement of the moving block 30 in the left and right direction. This will be described in detail later.

The connecting rod 31 may connect the moving bar 10 and the moving block 30. In more detail, the inner end portion of the connecting rod 31 may be rotatably connected to the upper portion of the moving bar 10, and the outer end portion may be rotatably connected to the moving block 30.

The connecting rod 31 is preferably connected to the upper end part of the moving bar 10.

The inner end portion of the connecting rod 31 may be higher than the outer end portion thereof. In other words, the connecting rod 31 may be disposed to be inclined in a direction in which the height thereof decreases toward the outside.

The connecting rod 31 may link the movement of the moving bar 10 in the vertical direction with the movement of the moving block 30 in the left and right direction. When the moving bar 10 lowers, the inclination of the connecting rod 31 becomes gentle and the moving block 30 can move outward. Conversely, when the moving bar 10 lifts, the inclination of the connecting rod 31 becomes steep and the moving block 30 can move inward.

The lower moving block 70 may be built in the extension part 8 of the lower frame 6. The lower moving block 70 can be moved inside the extension part 8 in the left and right direction. The lower moving block 70 may be built in the first extension part 8A and the second extension part 8B, respectively. The lower moving block 70 built in the first extension part 8A and the lower moving block 70 built in the second extension part 8B may move in opposite directions to each other.

The lower moving block 70 may be rotatably connected to the lower main links 61 and 62 described above. The lower main links 61 and 62 may rotate in the front and rear direction according to the movement of the lower moving block 70 in the left and right direction. This will be described in detail later.

The lower connecting rod 71 may connect the moving bar 10 and the lower moving block 70. In more detail, the inner end portion of the lower connecting rod 71 may be rotatably connected to the lower portion of the moving bar 10, and the outer end portion may be rotatably connected to the lower moving block 70.

The inner end portion of the lower connecting rod 71 may be higher than the outer end portion thereof. In other words, the lower connecting rod 71 may be disposed to be inclined in a direction in which the height thereof decreases toward the outside.

The lower connecting rod 71 may link the movement of the moving bar 10 in the vertical direction with the movement of the lower moving block 70 in the left and right direction. When the moving bar 10 lowers, the inclination of the lower connecting rod 71 becomes gentle and the lower moving block 70 can move outward. Conversely, when the moving bar 10 lifts, the inclination of the lower connecting rod 71 becomes steep and the lower moving block 70 can move inward.

Meanwhile, at least one long hole 11 may be formed in the moving bar 10, and an elastic member 12 may be disposed in each elongated hole 11. The long hole 11 may be formed long in the vertical direction. The elastic member 12 may provide an upward direction to the moving bar 10. The elastic member 12 may be a tension spring or a compression spring.

An insertion protrusion 1A may be provided inside the vertical frame 1. The insertion protrusion 1A may be inserted into the long hole 11 of the moving bar 10. The insertion protrusion 1A may be formed to protrude from the inner surface of the vertical frame 1 toward the long hole 11.

The elastic member 12 may be located between the insertion protrusion 1A and the long hole 11.

The elastic member 12 may be located in at least one of between the lower end of the long hole 11 and the insertion protrusion 1A, and between the upper end of the long hole 11 and the insertion protrusion 1A. In other words, the elastic member 12 may be located below and/or above the insertion protrusion 1A.

In this case, when the moving bar 10 lowers with respect to the vertical frame 1, the upper end of the long hole 11 may be close to the insertion protrusion 1A, and the elastic member 12 may be compressed or tensioned. Accordingly, the elastic member 12 may provide an upward elastic force to the moving bar 10 by the restoring force of the elastic member 12.

Figure 5:
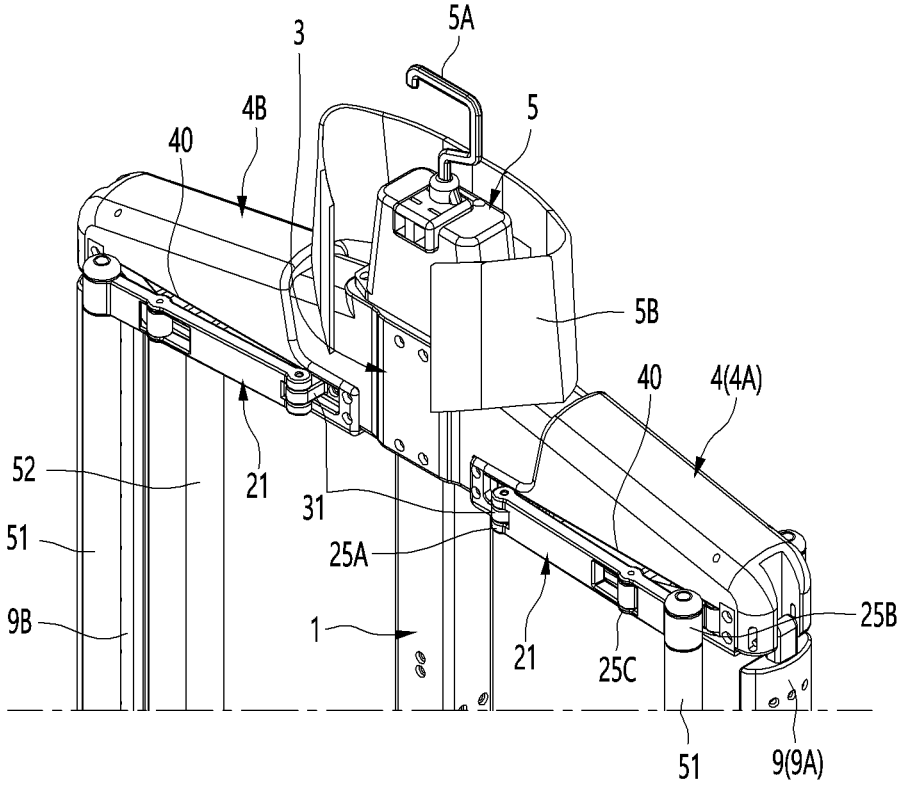
FIG. 5 is an enlarged view illustrating the upper part of the clothing hanger according to an embodiment of the present disclosure.
Figure 6:
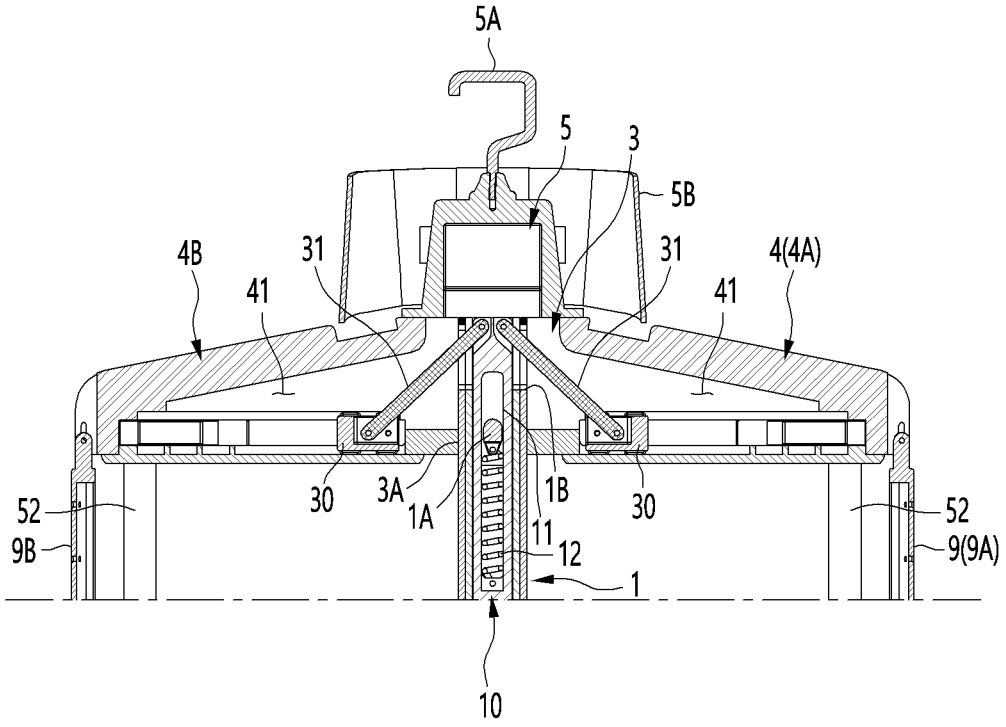
FIG. 6 is an enlarged cross-sectional view illustrating the inner portion of the upper side of the clothing hanger according to an embodiment of the present disclosure.
Figure 7:
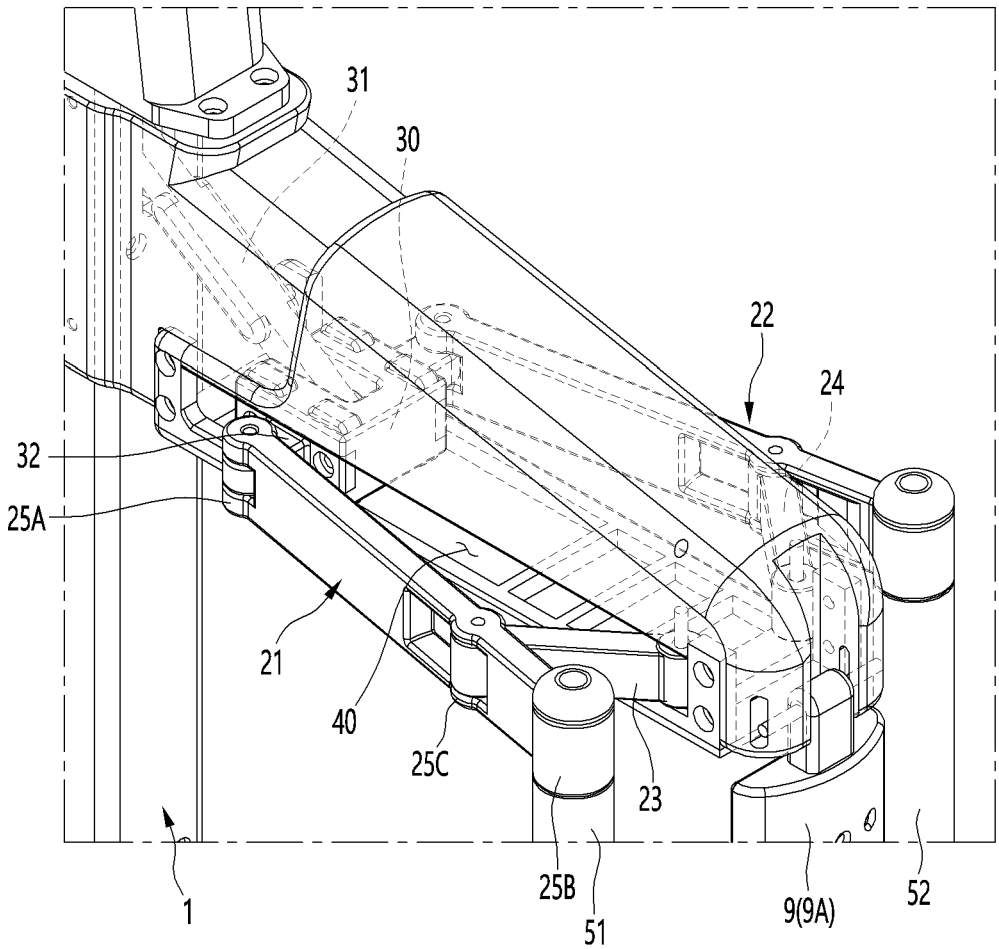
FIG. 7 is a diagram for explaining the operation of a moving block, a main link, and a sub link according to an embodiment of the present disclosure.

FIG. 5 is an enlarged view illustrating the upper part of the clothing hanger according to an embodiment of the present disclosure, FIG. 6 is an enlarged cross-sectional view illustrating the inner portion of the upper side of the clothing hanger according to an embodiment of the present disclosure, and FIG. 7 is a diagram for explaining the operation of a moving block, a main link, and a sub link according to an embodiment of the present disclosure.

A through-hole 1B through which the connecting rod 31 passes may be formed in both side surfaces of the moving bar 10. The through-hole 1B may be formed through left and right side surfaces of the upper portion of the moving bar 10 in the left and right direction. The through-hole 1B may be formed long in the vertical direction so as not to interfere with the connecting rod 31 which rotates as the moving bar 10 lifts.

A connector 32 to which the main links 21 and 22 are rotatably connected may be provided on the front and rear surfaces of the moving block 30. In addition, a long hole 40 through which the connector 32 passes and which is formed long in the left and right direction may be formed on the front and rear surfaces of the support part 4.

The connector 32 may rotatably connect the main links 21 and 22 to the moving block 30. The connector 32 may pass through the long hole 40 and protrude forward or rearward of the support part 4. The connector 32 can move in the left and right direction together with the moving block 30 while maintaining the state of passing through the long hole 40.

The front link 21 is provided on the front surface of the moving block 30 and may be rotatably connected to the connector 32 protruding forward of the support part 4. The rear link 22 is provided on the rear surface of the moving block 30 and may be rotatably connected to the connector 32 protruding to the rearward of the support part 4. The connector 32 connected to the front link 21 may be referred to as a front connector, and the connector 32 connected to the rear link 22 may be referred to as a rear connector.

The long hole 40 formed on the support part 4 can prevent the connector 32 and the support part 4 from interfering. In addition, the moving block 30 and the connector 32 may move along the long hole 40 in the left and right direction. In other words, the long hole 40 formed in the support part 4 may guide the movement of the moving block 30 and the connector 32 in the left and right direction.

In addition, an avoidance groove 41 for avoiding interference with the connecting rod 31 may be formed in the support part 4. The avoidance groove 41 may be formed by being depressed upwardly from the inner upper surface of the support part 4. The avoidance groove 41 may be formed long in the inclined direction of the upper surface of the support part 4. Accordingly, the connecting rod 31 connected to the moving block 30 may not interfere with the inner surface of the support part 4.

Meanwhile, the main links 21 and 22 may include a first connection part 25A connected to the moving block 30, a second connection part 25B connected to the vertical bars 51 and 52, and a third connection part 25C to which the sub links 23 and 24 are connected.

In more detail, the first connection part 25A may be rotatably connected to the connector 32. The second connection part 25B may be connected to the upper end of the vertical bars 51 and 52. The inner end portions of the sub links 23 and 24 may be rotatably connected to the third connection part 25C.

The first connection part 25A may be located at the inner end portion of the main links 21 and 22. The second connection part 25B may be located at an outer end portion of the main links 21 and 22. The third connection part 25C may be located between both end portions of the main links 21 and 22.

A distance between the third connection part 25C and the second connection part 25B may be shorter than a distance between the third connection part 25C and the first connection part 25A. In other words, the third connection part 25C may be more adjacent to an outer end portion of both end portions of the main links 21 and 22.

In more detail, the first connection part 25A of the front link 21 may be rotatably connected to the connector 32 provided on the front surface of the moving block 30. The second connection part 25B of the front link 21 may be connected to the upper end of the front vertical bar 51. An inner end portion of the front sub link 23 may be rotatably connected to the third connection part 25C of the front link 21.

The first connection part 25A of the rear link 22 may be rotatably connected to the connector 32 provided on the rear surface of the moving block 30. The second connection part 25B of the rear link 22 may be connected to an upper end of the rear vertical bar 52. An inner end portion of the rear sub link 24 may be rotatably connected to the third connection part 25C of the rear link 22.

Figure 8:
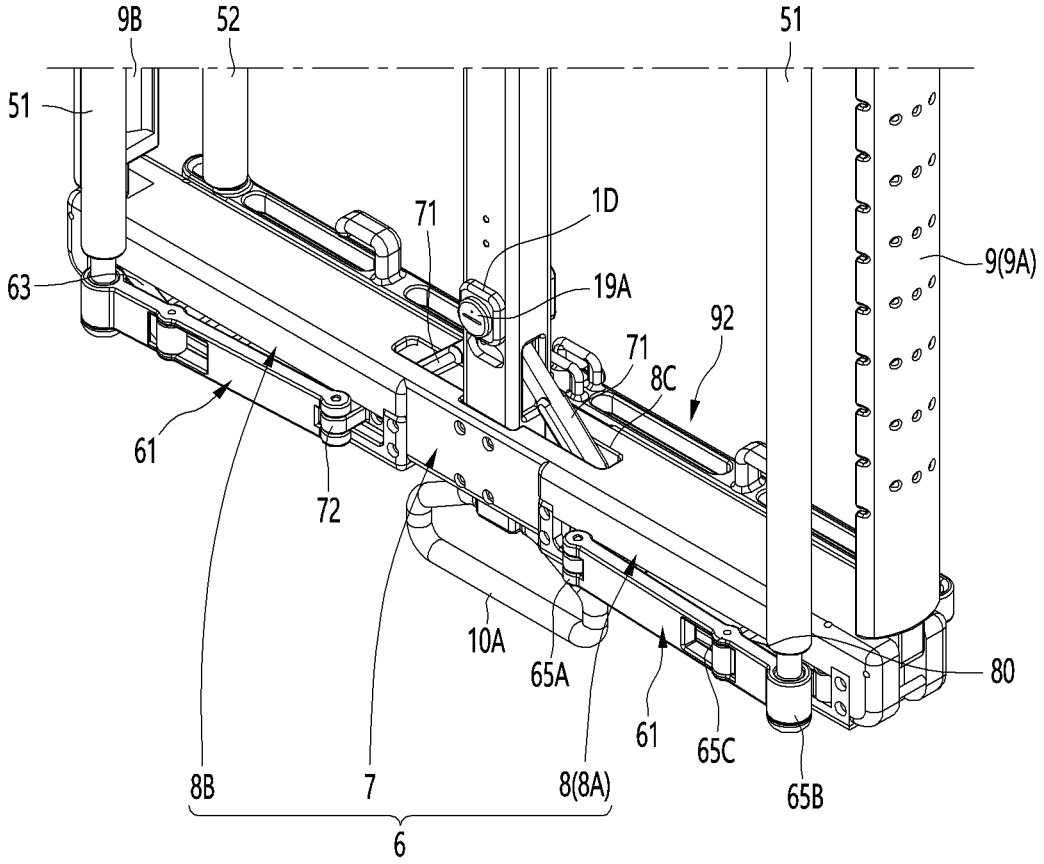
FIG. 8 is an enlarged view illustrating a lower portion according to an embodiment of the present disclosure.
Figure 9:
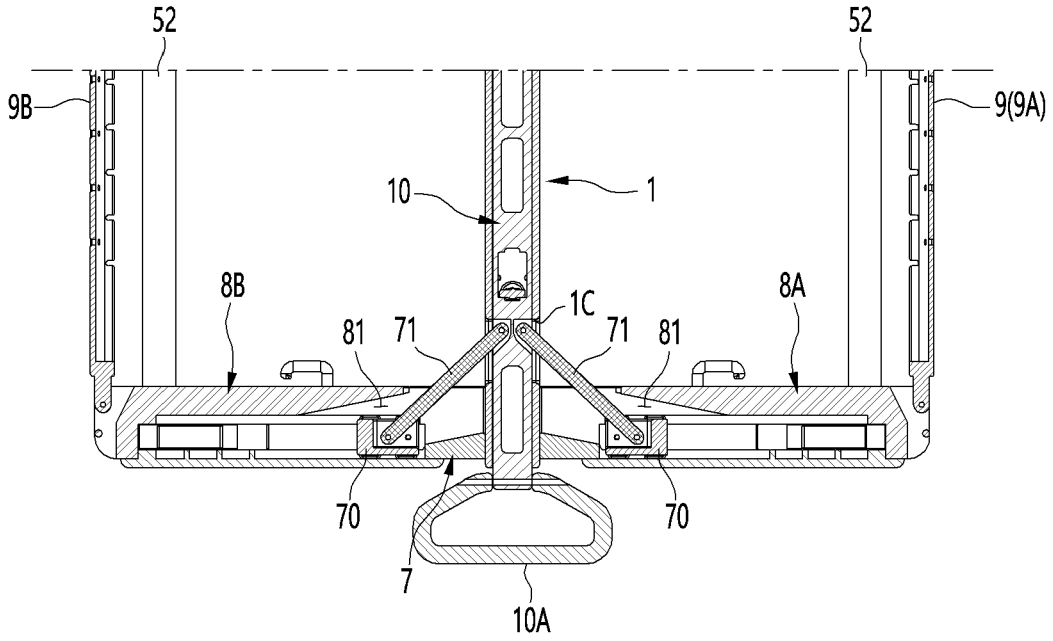
FIG. 9 is an enlarged cross-sectional view illustrating the inner portion of the lower side of the clothing hanger according to an embodiment of the present disclosure.
Figure 10:
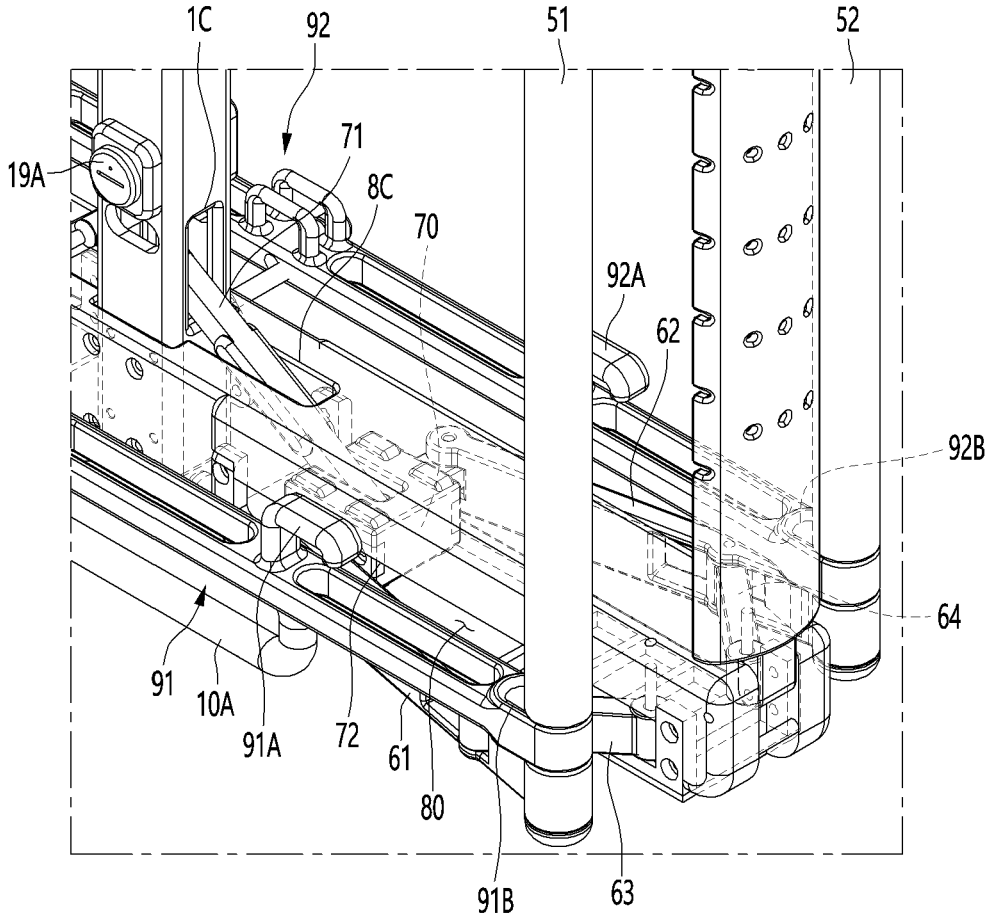
FIG. 10 is a view for explaining the operation of the lower moving block, the lower main link, and the lower sub link according to an embodiment of the present disclosure.

FIG. 8 is an enlarged view illustrating a lower portion according to an embodiment of the present disclosure, FIG. 9 is an enlarged cross-sectional view illustrating the inner portion of the lower side of the clothing hanger according to an embodiment of the present disclosure, and FIG. 10 is a view for explaining the operation of the lower moving block, the lower main link, and the lower sub link according to an embodiment of the present disclosure.

A lower through-hole 1C through which the lower connecting rod 71 passes may be formed on both side surfaces of the moving bar 10. The lower through-hole 1C may be formed by passing through left and right side surfaces of the lower portion of the moving bar 10 in the left and right direction. The lower through-hole 1C may be formed long in the vertical direction so as not to interfere with the lower connecting rod 71 which rotates according to the lifting of the moving bar 10.

In addition, an opening 8C through which the lower connecting rod 71 passes may be formed on the upper surface of the lower frame 6. The opening 8C may be formed by vertically passing through the upper surface of the inner portion of each extension part 8. The opening 8C may extend to the upper surface of the fastening part 7. The opening 8C may be formed long in the left and right direction so as not to interfere with the lower connecting rod 71 which rotates according to the lifting of the moving bar 10.

A lower connector 72 to which the lower main links 61 and 62 are rotatably connected may be provided on the front and rear surfaces of the lower moving block 70. In addition, a long hole 80 through which the lower connector 72 passes and which is formed long in the left and right direction may be formed on the front and rear surfaces of the extension part 8 of the lower frame 6.

The lower connector 72 may rotatably connect the lower main links 61 and 62 to the lower moving block 70. The lower connector 72 may pass through the long hole 80 and protrude forward or rearward of the extension part 8. The lower connector 72 maintains a state of passing through the long hole 80 and can move together with the lower moving block 70 in the left and right direction.

The front lower link 61 is provided on the front surface of the lower moving block 70 and may be rotatably connected to the lower connector 72 protruding forward of the extension part 8. The rear lower link 62 is provided on the rear surface of the lower moving block 70 and may be rotatably connected to the lower connector 72 protruding to the rear of the extension part 8. The lower connector 72 connected to the front lower link 61 may be referred to as a front lower connector, and the lower connector 72 connected to the rear lower link 62 may be referred to as a rear lower connector.

The long hole 80 formed in the extension part 8 can prevent the lower connector 72 and the extension part 8 from interfering. In addition, the lower moving block 70 and the lower connector 72 may move along the long hole 80 in the left and right direction. In other words, the long hole 40 formed in the extension part 8 may guide the movement of the lower moving block 70 and the lower connector 72 in the left and right direction.

In addition, an avoidance groove 81 for avoiding interference with the lower connecting rod 71 may be formed inside the extension part 8. The avoidance groove 81 may be formed by being depressed upwardly from the inner upper surface of the extension part 8. The avoidance groove 81 may be formed long in an inclined direction such that the height thereof is lowered toward the outside. Accordingly, the lower connecting rod 71 connected to the lower moving block 70 may not interfere with the inner surface of the extension part 8.

Meanwhile, the lower main links 61 and 62 may include a first connection part 65A connected to the lower moving block 70, a second connection part 65B connected to the vertical bars 51 and 52, and a third connection part 65C to which the sub links 23 and 24 are connected.

In more detail, the first connection part 65A may be rotatably connected to the lower connector 72. The second connection part 65B may be connected to the lower ends of the vertical bars 51 and 52. The inner end portions of the lower sub links 63 and 64 may be rotatably connected to the third connection part 65C.

The first connection part 65A may be located at the inner end portion of the lower main links 61 and 62. The second connection part 65B may be located at the outer end portion of the lower main links 61 and 62. The third connection part 65C may be located between both end portions of the lower main links 61 and 62.

The distance between the third connection part 65C and the second connection part 65B may be shorter than the distance between the third connection part 65C and the first connection part 65A. In other words, the third connection part 65C may be more adjacent to an outer end portion of both end portions of the lower main links 61 and 62.

In more detail, the first connection part 65A of the front lower link 61 may be rotatably connected to the lower connector 72 provided on the front surface of the lower moving block 70. The second connection part 65B of the front lower link 61 may be connected to the lower end of the front vertical bar 51. An inner end portion of the front lower sub link 63 may be rotatably connected to the third connection part 65C of the front lower link 61.

The first connection part 65A of the rear lower link 62 may be rotatably connected to the lower connector 72 provided on the rear surface of the lower moving block 70. The second connection part 65B of the rear lower link 62 may be connected to a lower end of the rear vertical bar 52. An inner end portion of the rear lower sub link 64 may be rotatably connected to the third connection part 65C of the rear lower link 62.

Meanwhile, the clothing hanger according to the present embodiment may include horizontal bars 91 and 92 provided with hooks 91A and 92A.

Horizontal bars 91 and 92 may be disposed at the front and rear of the lower frame 6. In more detail, the pair of horizontal bars 91 and 92 may include a front horizontal bar 91 located in front of the lower frame 6 and a rear horizontal bar 92 located in the rear of the lower frame 6. However, for convenience of explanation, the front horizontal bar 91 is not illustrated in FIG. 8.

Horizontal bars 91 and 92 may connect a pair of vertical bars 51 and 52 to each other, which are spaced apart from one another. In more detail, the front horizontal bar 91 may connect the pair of front vertical bars 51 to each other, and the rear horizontal bar 92 may connect the pair of rear vertical bars 52 to each other.

Connection holes 91B and 92B connected to the vertical bars 51 and 52 may be formed at both end portions of the horizontal bars 91 and 92. The connection holes 91B and 92B may be located above the second connection part 65B of the lower main links 61 and 62. In other words, the end portions of the horizontal bars 91 and 92 may be located above the outer end portions of the lower main links 61 and 62.

The connection holes 91B and 92B may be formed long in the left and right direction. Accordingly, the vertical bars 51 and 52 can move smoothly without being constrained by the horizontal bars 91 and 92.

At least one hook 91A and 92A may be formed on the horizontal bars 91 and 92. The hooks 91A and 92A may be formed on the upper surfaces of the horizontal bars 91 and 92.

The hooks 91A and 92A of the horizontal bars 91 and 92 may apply a mechanical force by pulling the lower part of the clothing. For example, a separate clip (not illustrated) may be connected to the hooks 91A and 92A, and the clip may pull the lower portion of the clothing.

Accordingly, the hooks 91A and 92A can apply a downward mechanical force to the clothing, and the clothing may be taut.

Meanwhile, the button 19A may be located on the outer surface of the vertical frame 1. The button 19A may be located on the lower front surface of the vertical frame 1. The button 19A may be included in a stopper 19 (see FIG. 11) that prevents the moving bar 10 from lifting. When the user presses the button 19A, the moving bar 10 lifts by the elastic force of the elastic member 12 (see FIG. 4), and the clothing hanger that has been extended in the front and rear direction can be restored to the original state thereof. This will be described in detail below.

Figure 11:
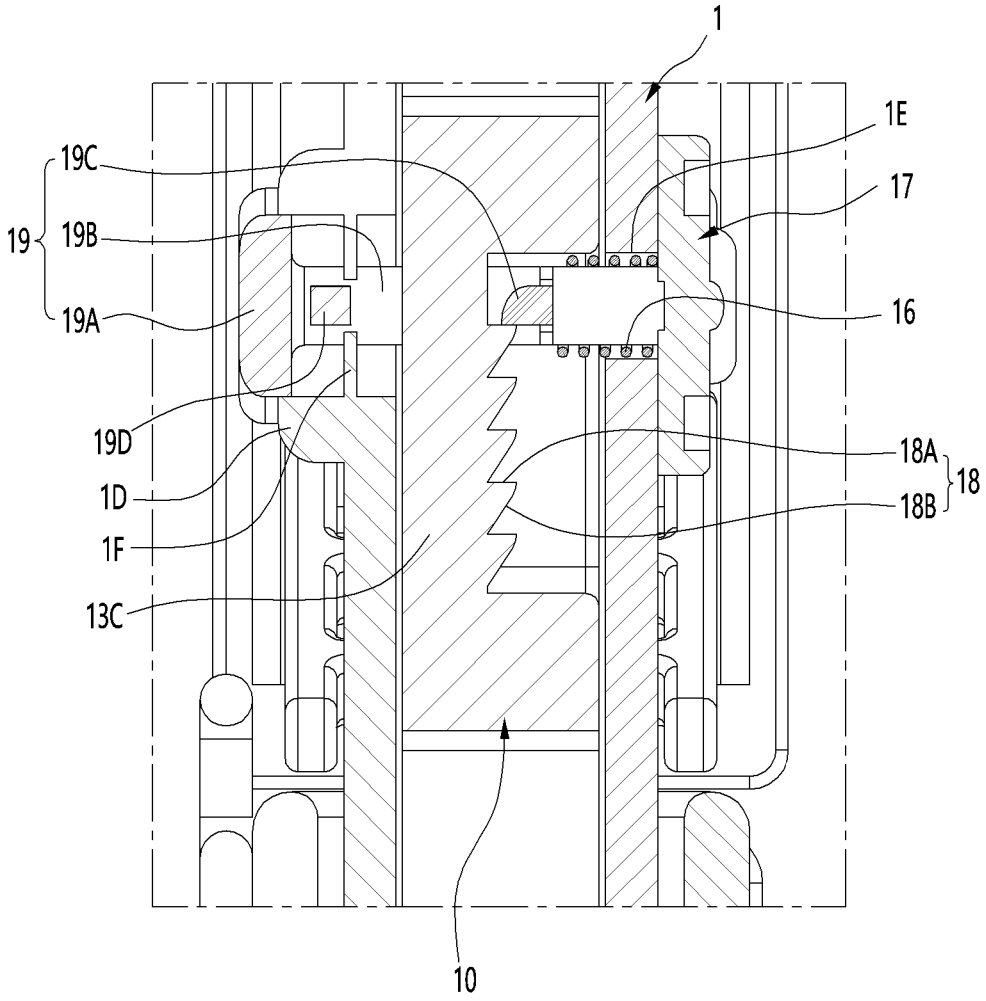
FIG. 11 is a view for explaining the operation of the stopper according to the embodiment of the present disclosure.
Figure 12:
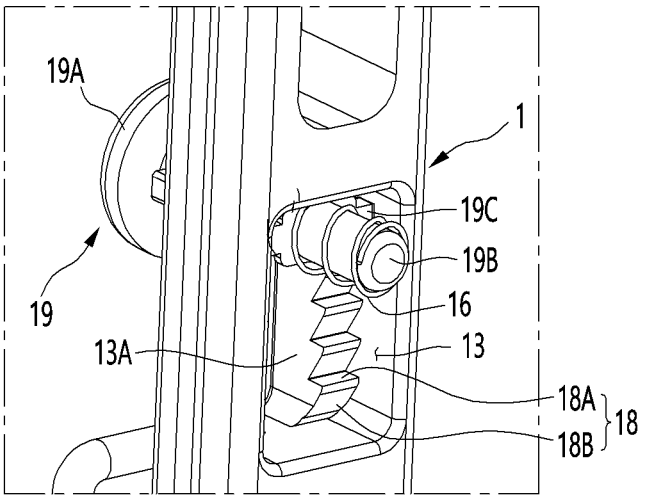
FIG. 12 is a view illustrating a connection relationship between a stopper and a moving bar according to an embodiment of the present disclosure.

FIG. 11 is a view for explaining the operation of the stopper according to the embodiment of the present disclosure, and FIG. 12 is a view illustrating a connection relationship between a stopper and a moving bar according to an embodiment of the present disclosure.

The clothing hanger according to an embodiment of the present disclosure may include a stopper 19 that prevents the moving bar 10 from lifting.

The stopper 19 may include a button 19A provided on the outer surface of the vertical frame 1, a stopper main body 19B formed long in the horizontal direction from the button 19A, and a protrusion 19C protruding from the stopper main body 19B and hung on the moving bar 10.

The button 19A may be provided on the outer surface of the vertical frame 1. In more detail, a stopper mounting part 1D to which the stopper 19 is mounted may be formed on the vertical frame 1. The stopper mounting part 1D may have a hollow cylindrical shape protruding forward from the lower front surface of the vertical frame 1.

The stopper mounting part 1D may surround the outer circumference of the button 19A. The inside of the stopper mounting part 1D may communicate with the internal space of the vertical frame 1.

The stopper 19 may be mounted to the stopper mounting part 1D to be movable in the horizontal direction, in more detail, in the front and rear direction. When the user presses the button 19A, the stopper 19 can move rearward, and when the user does not apply a force to the button 19A, the stopper 19 can move forward by the elastic force of the compression spring 16.

The stopper main body 19B may be formed long rearward from the button 19A. The diameter of the stopper main body 19B may be smaller than the diameter of the button 19A.

The stopper main body 19B may pass through the vertical frame 1. In more detail, the stopper main body 19B may be formed long from the inner portion of the button mounting part 1B to pass through the through-hole 1E formed on the rear surface of the vertical frame 1. In addition, an opening 13 through which the stopper main body 19B passes may be formed in the moving bar 10. The opening 13 may be a long hole that passes through in the front and rear direction and is formed long in the vertical direction. In addition, a connection cover 17 to cover the through-hole 1E and to which the rear end of the stopper main body 19B is connected may be provided on the rear surface of the vertical frame 1.

The protrusion 19C may protrude radially outward from the stopper main body 19B. In more detail, the protrusions 19C may protrude from the stopper main body 19B to both left and right sides. The protrusion 19C may be hung by the hanging part 18 formed on the moving bar 10. FIG. 11 illustrates a state where the moving bar 10 lowers to the maximum and the protrusion 19C is hung by the uppermost hanging part 18.

The hanging part 18 may be formed in the open hole 13 of the moving bar 10. In more detail, the protruding body 13A is formed on both sides of the inner circumference of the open hole 13, and a plurality of hanging parts 18 may be formed on the rear surface of the protruding body 13A.

The pair of protruding bodies 13A may protrude in a direction closer to each other on both sides of the inner circumference of the opening 13. The protruding body 13A may be formed long in the vertical direction.

The hanging part 18 may be formed to protrude rearward from the rear surface of the protruding body 13A.

There may be a plurality of hanging parts 18 formed on each protruding body 13A. For example, each of the protruding bodies 13A may have five hanging parts 18 formed therein. The plurality of hanging parts 18 may be formed at different heights.

Each of the hanging parts 18 may include a horizontal surface 18A on which the protrusion 19C is hung, and an inclined surface 18B connected to the horizontal surface 18A.

The horizontal plane 18A may be hung in contact with the bottom surface of the protrusion 19C. In other words, even if the moving bar 10 receives a force in the upward direction by the elastic force of the elastic member 12 (see FIG. 4), the horizontal surface 18A of the hanging part 18 is hung on the protrusion 19C and may not lift.

The inclined surface 18B may be formed to be inclined in a direction in which the height decreases from the rear end of the horizontal surface 18A toward the front.

In a case where the moving bar 10 lowers, the inclined surface 18B may press the protrusion 19C rearward. In more detail, the front surface of the protrusion 19C may be inclined or rounded in a direction in which the height decreases toward the front. Accordingly, when the moving bar 10 lowers, the inclined surface 18B may be in contact with the front surface of the protrusion 19C and push the protrusion 19C rearward. Accordingly, the moving bar 10 can be smoothly lowered without being hung by the protrusion 19C.

The lower end of the inclined surface 18B of any one of the hanging parts 18 may be connected to the front end of the horizontal surface 18A of the other hanging part 18 located below one of the hanging parts 18.

The stopper 19 may be provided with a compression spring 16. The compression spring 16 may provide an elastic force to the stopper 19 in a direction in which the protrusion 19C hung on the hanging part 18. In other words, the compression spring 16 may push the stopper 19 forward.

The compression spring 16 may be disposed on the outer circumference of the stopper main body 19B. The compression spring 16 may be located between the protrusion 19C and the connection cover 17.

When the user presses the button 19A, the protrusion 19C may compress the compression spring 16 by pressing it rearward. If the user does not apply force to the button 19A, the compression spring 16 may move the stopper 19 forward by pressing the protrusion 19C forward.

Since the plurality of hanging parts 18 are formed at different heights from each other, the height of the moving bar 10 and the degree of movement of the vertical bars 51 and 52 in the front and rear direction may vary according to the height of the hanging part 18 on which the protrusion 19C is hung.

A direction guide part 1F for guiding the mounting direction of the stopper 19 may be formed on the inner circumference of the stopper mounting part 1B. In addition, an auxiliary protrusion 19D may be formed on the stopper 19. The auxiliary protrusion 19D is located inside the stopper mounting part 1D and may protrude radially outward from the stopper main body 19B. In this case, the auxiliary protrusion 19D passes through the direction guide part 1F only in a case where the stopper 19 is inserted in the set direction, otherwise, the auxiliary protrusion 19D may be hung by the direction guide part 1F.

Hereinafter, the operation of the stopper 19 will be described.

When the user pulls the handle 10A at the lower end of the moving bar 10, the moving bar 10 may lower. When the moving bar 10 lowers, the inclined surface 18B of any one of the hanging parts 18 may press the protrusion 19C rearward. Accordingly, the stopper 19 may move rearward and the compression spring 16 may be compressed between the protrusion 19C and the connecting cover 17. Since the protrusion 19C has moved rearward, the moving bar 10 may lower.

When the inclined surface 18B of any one of the hanging parts 18 is lower than the protrusion 19C, the stopper 19 can move forward by the elastic force of the compression spring 16, and the protrusion 19C may be hung by the other hanging part 18 located above one of the hanging parts 18. In this case, when the user pulls the handle 10A at the lower end of the moving bar 10 again, the above-described process is repeated and the moving bar 10 may lower further.

When the moving bar 10 lowers, the front link 21 and the front lower link 61 may rotate forward, and the rear link 22 and the rear lower link 62 may rotate rearward. In other words, the front vertical bar 51 and the lower vertical bar 52 may be separated from each other.

Accordingly, the user can extend the clothing hanger in the front and rear direction by interlocking with the elevation of the moving bar 10.

Meanwhile, when the user presses the button 19A, the stopper 19 may move rearward. Accordingly, the protrusion 19C can compress the compression spring 16 without being hung by the hanging part 18.

Since the protrusion 19C is not hung by the hanging part 18, the moving bar 10 may lift by the elastic force of the elastic member 12 (see FIG. 2). Accordingly, the front link 21 and the front lower link 61 can rotate rearward, and the rear link 22 and the rear lower link 62 can rotate forward. In other words, the front vertical bar 51 and the lower vertical bar 52 may be close to each other.

Accordingly, the user can simply and conveniently restore the clothing hanger that has been extended in the front and rear direction by pressing the button 19A.

Figure 13:
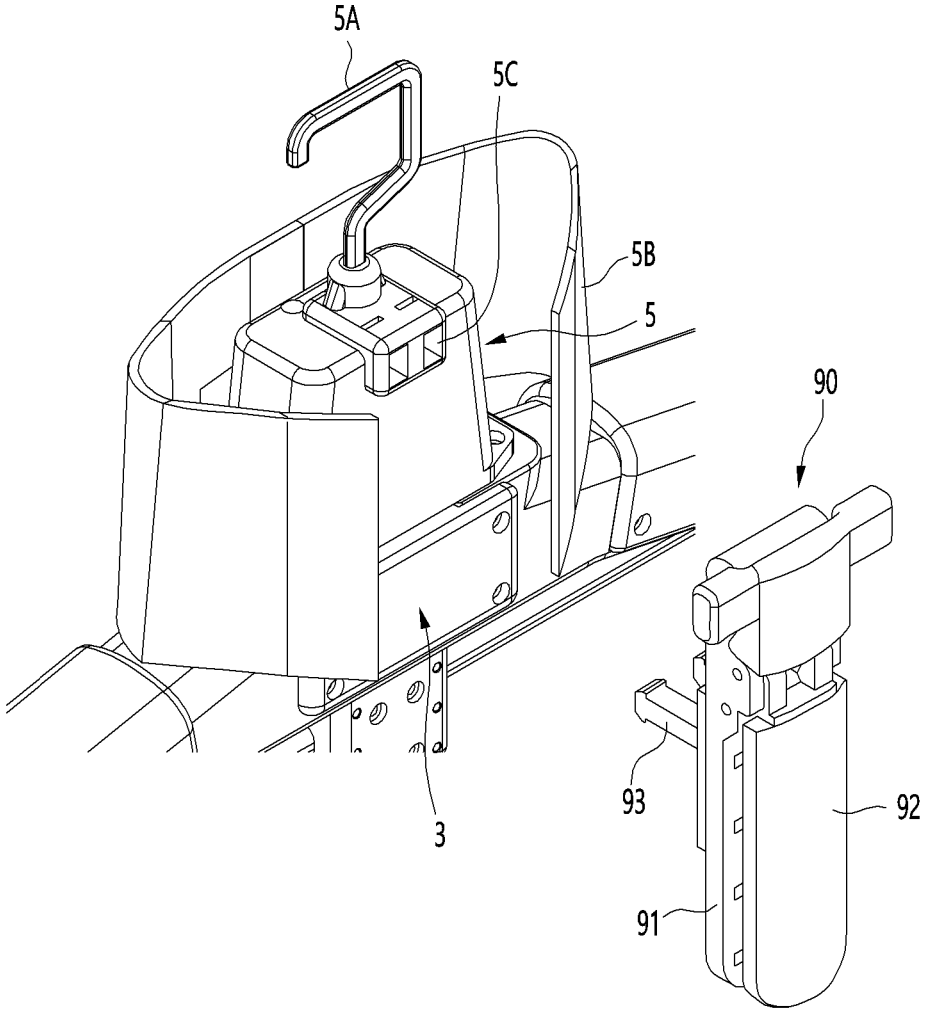
FIG. 13 is a view illustrating an elastic band and a band fixing device according to an embodiment of the present disclosure.

FIG. 13 is a view illustrating an elastic band and a band fixing device according to an embodiment of the present disclosure.

The clothing hanger according to the embodiment of the present disclosure may further include a band fixing device 90 for fixing the elastic band 5B.

The band fixing device 60 may be fastened at the front of the upper body 5. In more detail, a fastening hole 5C to which the band fixing device 90 is fastened may be formed on the front surface of the upper body 5.

The band fixing device 90 includes a main body 91, a fixing part 92 is hinged to the main body 91 to fix the elastic band 5B and a fastening part 93 which protrudes from the rear of the main body 91 to fasten to the upper body 5.

The main body 91 may have a plate shape which is formed long in the vertical direction.

The fixing part 92 may be provided in front of the main body 91. The fixing part 92 is hinged to the main body 91 to be able to rotate in the vertical direction. Preferably, a torsion spring (not illustrated) providing an elastic force for rotating the fixing part 92 toward the main body 91 is provided on the hinge. The fixing part 92 may fix the elastic band 5B together with the main body 91. In more detail, both end portions of the elastic band 5B may be fixed between the main body 91 and the fixing portion 92.

The fastening part 93 may be formed long rearward from the rear surface of the main body 91. The fastening part 93 may be inserted into the fastening hole 5C of the upper body 5.

Since the band fixing device 90 fixes the elastic band 5B, the elastic band 5B can stably support the collar of clothing having various shapes.

According to a preferred embodiment of the present disclosure, a vertical bar may be connected to the main link rotating in the front and rear direction. Accordingly, the clothing hanger can be extended in the front and rear direction to stably support clothing of various sizes.

In addition, the moving bar may be interlocked with the main link by the connecting rod and the moving block. Accordingly, the user can simply extend the clothing hanger in the front and rear direction by pulling the handle connected to the moving bar downward.

In addition, the sub link assists the rotation of the main link, so that the vertical bar can smoothly rotate in the front and rear direction.

In addition, the upper body included in the support frame may be provided with an elastic band elastically deformed, the band fixing device may fix the elastic band. Accordingly, this allows the elastic band to stably support the collar of the clothing.

In addition, when the user presses the button, the moving bar can move upward by the elastic force of the elastic member, and the clothing hanger which is extended in the front and rear direction can be restored simply and conveniently.

In addition, a plurality of hanging parts to which the stopper is applied may be formed at different heights of the moving bar from each other. Accordingly, the degree of extension of the clothing hanger in the front and rear direction can be easily adjusted.

In addition, the compression spring may provide an elastic force to the stopper in a direction in which the protrusion hangs on the hanging part. Accordingly, if the user does not apply force to the button, the stopper can prevent the moving bar from lifting.

In addition, the hanging part may include a horizontal surface and an inclined surface. Accordingly, in a case where the moving bar lowers, the protrusion does not hang on the hanging part, but in a case where the moving bar lifts, the protrusion may become hung on the hanging part.

In addition, a long hole through which a connector connected to the moving block passes may be formed on the front and rear surfaces of the support part of the support frame. Accordingly, the movement of the moving block in the left and right direction can be guided, and the main link can be easily connected to the connector.

In addition, both end portions of the main link may be connected to the moving block and the vertical bar, and the sub link may be connected between both end portions of the main link. In this case, the connection part to which the sub link is connected may be adjacent to the end portion to which the vertical bar is connected. Accordingly, the vertical bar can easily move by a predetermined range in the front and rear direction.

In addition, the lower end of the vertical bar may be connected to the lower main link that rotates in the front and rear direction. Accordingly, the vertical bar can apply mechanical force in the front and rear rearward direction from the upper part to the lower part of the clothing, as a whole, and the clothing can be kept taut.

In addition, the side frame may be elastically deformed to suit the shape of the clothing to apply a mechanical force.

In addition, the hook provided on the horizontal bar can apply a downward mechanical force to the clothing. This may cause the clothing to be taut in the vertical direction.

What is claimed is:

1. A clothing hanger comprising:

a vertical frame;

a support frame including a center part connected to an upper end of the vertical frame and a pair of support parts formed long from both sides of the center part to support clothing;

a moving bar configured to be provided in an inner portion of the vertical frame to be capable of elevating;

a moving block configured to be embedded in the support part and to move in a left and right direction according to the elevation of the moving bar;

a connecting rod configured to connect the moving bar and the moving block;

a main link configured to be located at the front and rear of the support part and to be rotatably connected to the moving block;

a sub link configured to be rotatably connected to the support part and the main link, respectively; and a vertical bar configured to be connected to the main link and to be formed long in a vertical direction.

2. The clothing hanger of claim 1, further comprising:

a handle configured to be connected to the lower end of the moving bar and located below the vertical frame.

3. The clothing hanger of claim 1, wherein the support frame further includes an upper body fastened on the upper side of the center part, and wherein the upper body includes a hook fastened to the upper surface of the upper body; and an elastic band which is elastically deformed and surrounds at least a portion of the upper body.

4. The clothing hanger of claim 3, further comprising:
a band fixing device configured to be fastened at the front of the upper body and to fix the elastic band.

5. The clothing hanger of claim 1, further comprising:
an elastic member configured to provide an upward elastic force to the moving bar.

6. The clothing hanger of claim 5, further comprising:
a stopper configured to prevent the lifting of the moving bar,
wherein the stopper includes
a button provided on the outer surface of the vertical frame;
a stopper main body formed long from the button in a horizontal direction and configured to pass through the vertical frame; and
a protrusion configured to protrude from the stopper main body and to hang on the hanging part of the moving bar.

7. The clothing hanger of claim 6,
wherein a plurality of hanging parts are formed, and
wherein the plurality of hanging parts are located at different heights from each other.

8. The clothing hanger of claim 6, further comprising:
a compression spring configured to provide an elastic force to the stopper in a direction in which the protrusion hangs on the hanging part.

9. The clothing hanger of claim 8,
wherein the hanging part includes
a horizontal surface on which the protrusion hangs; and
an inclined surface connected to the horizontal surface and configured to press the protrusion in a direction in which the stopper compresses the compression spring.

10. The clothing hanger of claim 1,
wherein a connector to which the main link is rotatably connected is provided on the front and rear surfaces of the moving block, and
wherein a long hole through which the connector passes and which is formed long in the left and right direction is formed on the front and rear surfaces of the support part.

11. The clothing hanger of claim 1,
wherein the main link includes
a first connection part located at an inner end part of the main link and connected to the moving block;
a second connection part located at an outer end part of the main link and connected to the vertical bar; and
a third connection part located between the first connection part and the second connection part and to which the sub link is connected.

12. The clothing hanger of claim 11,
wherein a distance between the third connection part and the second connection part is shorter than a distance between the third connection part and the first connection part.

13. The clothing hanger of claim 1, further comprising:
a lower frame including a fastening part fastened to a lower portion of the vertical frame and a pair of extension parts formed long at both sides of the fastening part;
a lower moving block embedded in the extension part and configured to move according to the elevation of the moving bar in the left and right direction;
a lower connecting rod configured to connect the moving bar and the lower moving block;
a lower main link located at the front and rear of the extension part and rotatably connected to the lower moving block; and
a lower sub link rotatably connected to the extension part and the lower main link, respectively.

14. The clothing hanger of claim 13,
wherein the vertical bar connects the main link and the lower main link.

15. The clothing hanger of claim 13, further comprising:
a side frame configured to be formed long in the vertical direction and to connect the support part and the extension part.

16. The clothing hanger of claim 15,
wherein the side frame is elastically deformable.

17. The clothing hanger of claim 13,
wherein a connector to which the main link is rotatably connected is provided on the front and rear surfaces of the lower moving block, and
wherein a long hole through which the connector passes and which is formed long in the left and right direction is formed on the front and rear surfaces of the extension part.

18. The clothing hanger of claim 13,
wherein the lower main link includes
a first connection part located at an inner end part of the lower main link and connected to the lower moving block;
a second connection part located at an outer end part of the lower main link and connected to the vertical bar; and
a third connection part located between the first connection part and the second connection part and to which the lower sub link is connected.

19. The clothing hanger of claim 18,
wherein a distance between the third connection part and the second connection part is shorter than a distance between the third connection part and the first connection part.

20. The clothing hanger of claim 18, further comprising:
a horizontal bar configured to connect the lower portions of a pair of vertical bars spaced apart in the left and right direction to each other and having a hook on the upper side thereof.

* * * * *